United States Patent [19]

Gorin et al.

[11] 4,261,809

[45] Apr. 14, 1981

[54] METHOD FOR REMOVING ACID GASES FROM A GASEOUS STREAM

[75] Inventors: Everett Gorin, San Rafael, Calif.; Clyde W. Zielke, McMurray, Pa.

[73] Assignee: Conoco Inc., Stamford, Conn.

[21] Appl. No.: 102,163

[22] Filed: Dec. 10, 1979

[51] Int. Cl.[3] ..... C10G 1/06; C10G 47/08; B01J 35/12; C01B 7/01

[52] U.S. Cl. ..... 208/108; 208/10; 252/416; 423/240

[58] Field of Search ..... 208/108, 10; 423/240

[56] References Cited

U.S. PATENT DOCUMENTS

| | | | |
|---|---|---|---|
| 3,355,376 | 11/1967 | Gorin et al. | 208/108 |
| 3,371,049 | 2/1968 | Gorin et al. | 208/108 X |
| 3,736,250 | 5/1973 | Berg et al. | 208/10 |
| 3,764,515 | 10/1973 | Kiovsky | 208/10 |
| 4,081,400 | 3/1978 | Gorin | 208/10 |
| 4,136,056 | 1/1979 | Zielke | 208/108 X |

*Primary Examiner*—W. J. Shine
*Assistant Examiner*—G. E. Schmitkons
*Attorney, Agent, or Firm*—F. Lindsey Scott; William A. Mikesell, Jr.

[57] ABSTRACT

In a process for hydrocracking a heavy aromatic polynuclear carbonaceous feedstock containing reactive alkaline constituents to produce liquid hydrocarbon fuels boiling below about 475° C. at atmospheric pressure by contacting the feedstock with hydrogen in the presence of a molten metal halide catalyst, thereafter separating a gaseous stream containing hydrogen, at least a portion of the hydrocarbon fuels and acid gases from the molten metal halide and regenerating the molten metal halide, thereby producing a purified molten metal halide stream for recycle to the hydrocracking zone, an improvement comprising; contacting the gaseous acid gas, hydrogen and hydrocarbon fuels-containing stream with the feedstock containing reactive alkaline constituents to remove acid gases from the acid gas containing stream. Optionally at least a portion of the hydrocarbon fuels are separated from gaseous stream containing hydrogen, hydrocarbon fuels and acid gases prior to contacting the gaseous stream with the feedstock.

7 Claims, No Drawings

METHOD FOR REMOVING ACID GASES FROM A GASEOUS STREAM

This invention resulted from work conducted pursuant to a contract with the United States Department of Energy under Contract No. EX-76-C-01-1748.

This invention relates to an improved method for the removal of acid gases from off gases produced by the hydrogenation of coal or coal-derived feedstocks containing alkaline constituents in the presence of a molten metal halide.

In recent years, it has become increasingly apparent that the petroleum supplies available worldwide are limited and that the demand for such fuel supplies is increasing. As a result, a considerable amount of effort has been devoted in recent years to the development of processes whereby alternate fuel sources can be used. In particular, a considerable amount of effort has been directed to the development of methods for the use of coal to produce fuels which are presently supplied from petroleum feedstocks. In particular, efforts have been directed to the development of methods whereby light liquid hydrocarbon fuels boiling below about 475° C. can be produced. Some such fuels which are in high demand are gasoline, diesel fuel and the like.

One method which has been developed for the production of such fuels from coal, comprises the use of massive amounts of molten metal halide as a catalyst for hydrogenating heavy aromatic polynuclear carbonaceous feedstocks, such as coal, to produce lighter liquid hydrocarbon feedstocks boiling below about 475° C. Some such processes are shown in the following U.S. Patents:

| U.S. Pat. No. | Issue Date | Inventor |
|---|---|---|
| 3,355,376 | 11/28/67 | Gorin et al. |
| 3,371,049 | 2/27/68 | Gorin et al. |
| 3,594,329 | 7/20/71 | Gorin et al. |
| 3,625,861 | 12/7/71 | Gorin et al. |
| 3,629,159 | 12/21/71 | Gorin et al. |
| 3,708,270 | 1/2/73 | Birk et al. |
| 3,728,252 | 4/17/73 | Pitchford |
| 3,736,250 | 5/29/73 | Berg et al. |
| 3,764,515 | 10/9/73 | Kiovsky |
| 3,790,468 | 2/5/74 | Loth |
| 3,790,469 | 2/5/74 | Loth et al. |
| 3,844,928 | 10/29/74 | Geymer |
| 3,998,607 | 12/21/76 | Wesselhoft et al. |
| 4,081,400 | 3/28/78 | Gorin |
| 4,120,668 | 10/17/78 | Graley |
| 4,132,628 | 1/2/79 | Pell |
| 4,134,826 | 1/16/79 | Gorin |
| 4,136,056 | 1/23/79 | Zielke |

In such processes, the molten metal halide, which is desirably zinc chloride, is mixed with such feedstock in amounts which may approximate equal portions by weight of zinc chloride and feedstock in the presence of hydrogen at a pressure from about 1000 to about 4500 psi, preferably from about 2000 to about 3000 psi, at temperatures from about 675 to about 900° F. preferably from about 775 to about 825° F. to produce a gaseous stream containing hydrogen, at least a portion of the product hydrocarbon fuels and acid gases, and a spent melt stream from which further quantities of hydrocarbon fuels may be recovered. Typically quantities of condensible fuels are separated from the gaseous stream leaving an off gas stream comprising light hydrocarbon fuels, hydrogen and acid gases. The spent melt, which comprises molten zinc chloride containing typically from about 4 to about 6 weight percent carbon, may be incinerated in a suitable fluidized bed to therby purify and vaporize the zinc chloride for subsequent condensation and recycle to the hydrogenation vessel.

In the practice of the improvement of the present invention, the acid gases such as HCl are removed from such gaseous streams containing hydrocarbon fuels by contacting such gaseous streams with the coal or coal-derived feedstock containing inherently reactive alkaline constituents charged to the process.

The coal feedstock used can be of substantially any grade so long as the coal contains sufficient reactive alkaline constituents, such as alkali and alkaline earth metal humates, which are free to react with acid gases to effectively absorb acid gases from the gaseous stream. Typically the alkali metals encountered will include sodium, potassium and the like and the alkaline earth metals commonly encountered will include calcium, magnesium and the like. As is well known to those in the art, subbituminous and lignite coals tend to have a relatively high concentration of such materials, whereas many higher rank coals such as bituminous, anthracite and the like coals have a concentration of such materials which is generally lower and the alkaline constituents of such coals tend to be unreactive. The primary requisite in the coal is that it have enough reactive alkaline constituents to absorb the acid gases, such as HCl, present in the gas. Subbituminous and lignite coals are preferred in this respect. The coal is desirably finely ground and slurried in a hydrocarbon oil having a boiling point above about 200° C. for charging to the hydrogenation zone. The slurry of coal in oil is desirably used to contact the gaseous stream for the removal of acid gases. Clearly the coal could be used for such contacting prior to slurrying with oil but it is more difficult to handle a fine-sized "dry" feed coal in order to achieve effective contact between the gases and the coal than when a slurry of coal in oil is used.

The gaseous stream treated may include the whole vaporous stream produced in the hydrocracking zone, but it is expected that the contacting of the whole gaseous stream will result in various disadvantages in the contacting operation. As a result it is preferred that at least a major portion of the condensible hydrocarbon fuels i.e., $C^{5+}$ hydrocarbon fuels, be separated from the vaporous stream. The condensible fuels are desirably separated prior to the contacting operation, by cooling the vaporous stream so that the condensible fuels are recovered as liquids. The remaining gas constituents including light hydrocarbons, i.e., typically $C_1$–$C_4$ hydrocarbons, hydrogen, water and acid gases are generally referred to as off gas and represent a gaseous stream discharged from the process. It is highly desirable that the HCl content of this gas be recovered for use in the process. Such is accomplished by the improvement of the present invention.

The term condensible hydrocarbon fuels as used herein refers generally to hydrocarbon fuels containing at least five carbon atoms.

Any suitable contacting vessel can be used, such as bubble columns, spray towers or the like, so long as effective contact between the gaseous stream and the coal-oil slurry is achieved. Acid gases, such as HCl $H_2S$ if present and the like, which are normally present in the gaseous stream are removed by such slurry contacting, so that the gaseous stream after the removal of HCl may be passed to further processing to recover substantially HCl free $C_1$–$C_4$ hydrocarbon fuels and hydrogen for recycle to the hydrocracking zone. The HCl absorbed in the coal-oil slurry is then passed back into the hydrogenation zone with the slurry thus resulting in a reduction in the net loss of HCl from the process. The gaseous stream typically contains from about 0.05 to about 0.2 mol percent HCl although the quantities of HCl contained in the gaseous stream may vary widely. The contacting equipment is desirably sized to accomplish contact between the gaseous stream and the coal-oil slurry for a time sufficient to result in the absorption of substantially all of the acid gases in the coal-oil slurry. In the event that it is considered desirable, more than one contacting zone can be used, although it is contemplated that in most instances a single contacting zone suitably sized will be found sufficient.

While a variety of metal halide compounds can be used as the catalyst, zinc chloride is clearly the preferred metal halide. Desirably the contacting is at an elevated pressure, i.e. from about 1000 to about 4500 psi, preferably from about 2000 to about 3000 psi, such as is available in the gaseous stream from the hydrocracking zone. In other words, the pressure of the gaseous stream is not reduced prior to contacting. Such is desirable since the absorption of acid gases by the coal is favored by higher pressures. Clearly, lower pressures could be used but a larger contacting zone would be required and otherwise unnecessary pressure changes in the gaseous stream would be required.

Suitable contacting temperatures are above about 375° F. Desirably the temperature is above the dew point of water in the contacting zone to eliminate condensation and so that the coal is dried during the contacting step. Desirably the temperature is from about 375° to about 500° F. Such variations are clearly known to those in the art and need not be discussed further.

While the discussion of the invention above has related to the use of coal feedstocks, coal derived feedstocks such as solvent refined coal and the like could also be used if they contain reactive alkaline constituents such as amines or the like which are effective in absorbing acid gases. Coal containing reactive alkaline constituents is a preferred feedstock.

Having thus described the invention by reference to certain of its preferred embodiments, it is respectfully pointed out that the embodiments are illustrative rather than limiting in nature and that many variations and modifications are possible within the scope of the present invention. Such variations and modifications may be considered obvious and desirable by those skilled in the art based upon a review of the foregoing description of preferred embodiments.

Having thus described the invention, I claim:

1. In a process for hydrocracking a heavy aromatic polynuclear carbonaceous feedstock containing reactive alkaline constituents to produce hydrocarbon fuels boiling below about 475° C. at atmospheric pressure by hydrocracking said feedstock with hydrogen in the presence of a molten metal halide catalyst, thereafter separating a gaseous stream containing hydrogen, at least a portion of said hydrocarbon fuels and acid gases from said molten metal halide and regenerating said molten metal halide thereby producing a purified molten metal halide for recycle to the hydrogenation zone, an improvement comprising: contacting said acid gas, hydrogen and hydrocarbon fuel containing gaseous stream with said feedstock containing reactive alkaline constituents to remove said acid gases from said acid gas containing stream.

2. The improvement of claim 1 wherein at least a major portion of the condensible hydrocarbon fuels are removed from said gaseous stream prior to said contacting.

3. The improvement of claim 2 wherein said heavy aromatic polynuclear carbonaceous feedstock containing reactive alkaline constituents is subbituminous coal or lignite.

4. The improvement of claim 3 wherein said coal is finely divided and mixed with a hydrocarbonaceous stream having a boiling point at atmospheric pressure greater than about 200° C., prior to said contacting.

5. The improvements of claim 3 wherein said reactive alkaline constituents are alkali or alkaline earth metal humates.

6. The improvement of claim 1 wherein said metal halide is zinc chloride.

7. The improvement of claim 1 wherein said contacting is at a pressure from about 1000 to about 4500 psi.

* * * * *

UNITED STATES PATENT OFFICE

CERTIFICATE OF CORRECTION

PATENT NO. : 4,261,809

DATED : April 14, 1981

INVENTOR(S) : Everett Gorin & Clyde W. Zielke

It is certified that error appears in the above-identified patent and that said Letters Patent are hereby corrected as shown below:

Column 1, line 7, "1748" should read --1743--

Signed and Sealed this

*Fifteenth* Day of *September 1981*

[SEAL]

*Attest:*

GERALD J. MOSSINGHOFF

*Attesting Officer*

*Commissioner of Patents and Trademarks*